US007422076B2

(12) United States Patent
Koederitz et al.

(10) Patent No.: US 7,422,076 B2
(45) Date of Patent: Sep. 9, 2008

(54) AUTOREAMING SYSTEMS AND METHODS

(75) Inventors: William Leo Koederitz, Cedar Park, TX (US); Michael Nathan Porche, Round Rock, TX (US); C. Randall Thomas, Austin, TX (US)

(73) Assignee: Varco I/P, Inc., Houston, TX (US)

( * ) Notice: Subject to any disclaimer, the term of this patent is extended or adjusted under 35 U.S.C. 154(b) by 231 days.

(21) Appl. No.: 11/514,384

(22) Filed: Aug. 31, 2006

(65) Prior Publication Data

US 2007/0056772 A1 Mar. 15, 2007

Related U.S. Application Data

(63) Continuation-in-part of application No. 10/745,247, filed on Dec. 23, 2003, now Pat. No. 7,100,708.

(51) Int. Cl.
*E21B 7/28* (2006.01)
*E21B 44/02* (2006.01)

(52) U.S. Cl. ..... 175/26; 175/40; 175/45; 175/53

(58) Field of Classification Search ..... None
See application file for complete search history.

(56) References Cited

U.S. PATENT DOCUMENTS

| | | | | |
|---|---|---|---|---|
| 3,605,919 | A | 9/1971 | Bromell et al. | |
| 4,507,735 | A | 3/1985 | Moorehead et al. | 364/27 |
| 4,549,431 | A | 10/1985 | Soeiinah | 73/152.49 |
| 4,553,429 | A | 11/1985 | Evans et al. | 73/152.21 |
| 4,606,415 | A | 8/1986 | Gray, Jr. et al. | |
| 4,616,321 | A | 10/1986 | Chan | 364/422 |
| 4,685,329 | A | 8/1987 | Burgess | |
| 4,793,421 | A | 12/1988 | Jasinski | 175/27 |
| 4,875,530 | A | 10/1989 | Frink et al. | 175/27 |
| 5,273,112 | A | 12/1993 | Schultz | 166/374 |
| 5,368,108 | A | 11/1994 | Aldred et al. | 175/40 |
| 5,465,798 | A | 11/1995 | Edlund et al. | 175/24 |
| 5,597,042 | A | 1/1997 | Tubel et al. | 166/250.01 |

(Continued)

FOREIGN PATENT DOCUMENTS

EP 0939195 A2 4/1999

(Continued)

OTHER PUBLICATIONS

Design and Application Considerations For Inverters In Fluid Flow Control; Guggari. Lytle. Ehsani; pp. 1779-1783; 1 EEE; 1988.

(Continued)

*Primary Examiner*—Zakiya W. Bates
(74) *Attorney, Agent, or Firm*—Guy McClung

(57) ABSTRACT

Methods and systems for controlling movement of a bit of a drilling assembly during reaming of an already-drilled hole; the methods, in certain aspects, including determining a ream speed for downward movement of the bit in the hole, moving the bit downward in a hole at the ream speed, determining a time period for deceleration of the bit to the hole bottom, determining a value for a target drilling parameter for drilling beyond the bottom of the hole, decelerating the bit (linearly or non-linearly) for the time period, and achieving the value for the target drilling parameter when the bit reaches the bottom of the hole.

22 Claims, 9 Drawing Sheets

U.S. PATENT DOCUMENTS

| | | | | |
|---|---|---|---|---|
| 5,662,165 | A | 9/1997 | Tubel et al. | 166/250.01 |
| 5,706,896 | A | 1/1998 | Tubel et al. | 166/313 |
| 5,713,422 | A | 2/1998 | Dhindsa | 175/27 |
| 5,730,219 | A | 3/1998 | Tubel et al. | 66/250.01 |
| 5,732,776 | A | 3/1998 | Tubel et al. | 166/250.15 |
| 5,952,569 | A | 9/1999 | Jervis et al. | |
| 5,955,666 | A | 9/1999 | Mullins | 73/152.18 |
| 5,992,519 | A | 11/1999 | Ramakrishnan et al. | 166/250.15 |
| 6,021,377 | A | 2/2000 | Dubinsky et al. | |
| 6,029,951 | A | 2/2000 | Guggari | 254/269 |
| 6,233,524 | B1 | 5/2001 | Harrell et al. | |
| 6,237,404 | B1 | 5/2001 | Crary et al. | 73/152.03 |
| 6,346,813 | B1 | 2/2002 | Kleinberg | 324/303 |
| 6,356,205 | B1 | 3/2002 | Salvo et al. | 340/853.3 |
| 6,382,331 | B1 | 5/2002 | Pinckard | 175/27 |
| 6,438,495 | B1 | 8/2002 | Chau et al. | |
| 6,467,557 | B1 | 10/2002 | Kreuger et al. | 175/45 |
| 6,505,682 | B2 | 1/2003 | Brockman | 166/250.15 |
| 6,766,254 | B1 | 7/2004 | Bradford et al. | 702/9 |
| 6,868,920 | B2 | 3/2005 | Hoteit et al. | 175/25 |
| 6,873,267 | B1 | 3/2005 | Tubel et al. | 340/853.3 |
| 6,918,454 | B2 | 7/2005 | Prior et al. | 175/26 |
| 7,100,708 | B2 | 9/2006 | Koederitz | 175/27 |
| 2002/0103630 | A1 | 8/2002 | Aldred et al. | 703/10 |
| 2002/0112888 | A1 | 8/2002 | Leuchtenberg | 175/48 |
| 2003/0015351 | A1 | 1/2003 | Goldman et al. | 175/39 |
| 2003/0220742 | A1 | 11/2003 | Niedermayr et al. | 702/9 |
| 2004/0040746 | A1 | 3/2004 | Niedermayr et al. | 175/38 |
| 2004/0124009 | A1 | 7/2004 | Hoteit et al. | 175/25 |
| 2004/0195004 | A1 | 10/2004 | Power et al. | 175/24 |

FOREIGN PATENT DOCUMENTS

| | | | |
|---|---|---|---|
| GB | 2357539 | A | 10/1996 |
| GB | 2335450 | A | 3/1999 |

OTHER PUBLICATIONS

PCT Int'l Search Report; PCT/GB2007/050517; Oct. 31, 2007; 3pp.
Written Opinion of the Int'l Searching Authority; PCT/GB2007/050517; 5pp.

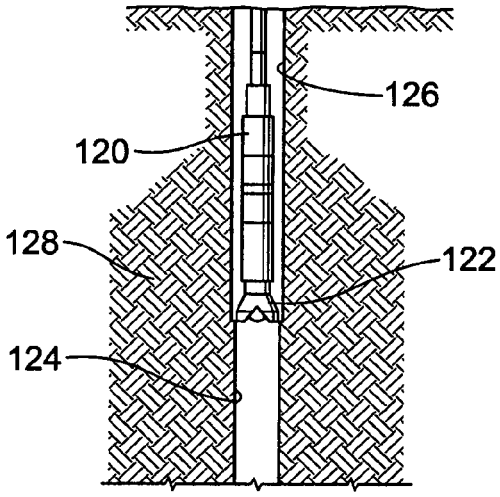
Fig. 8A
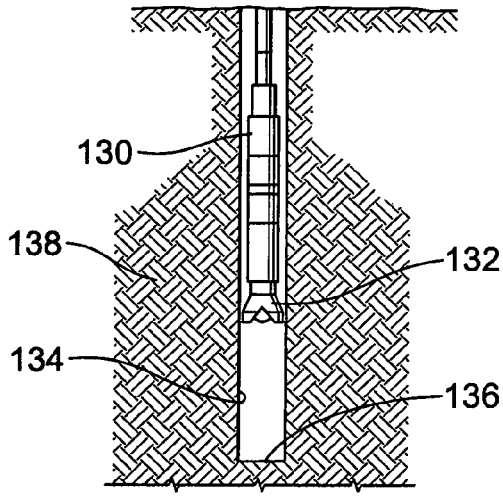
Fig. 8B
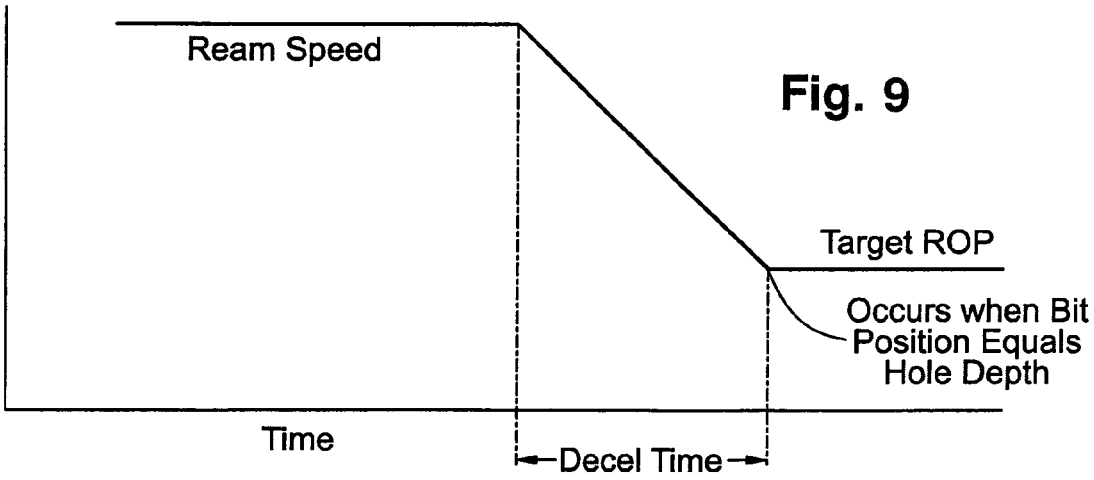
Fig. 9
Fig. 10
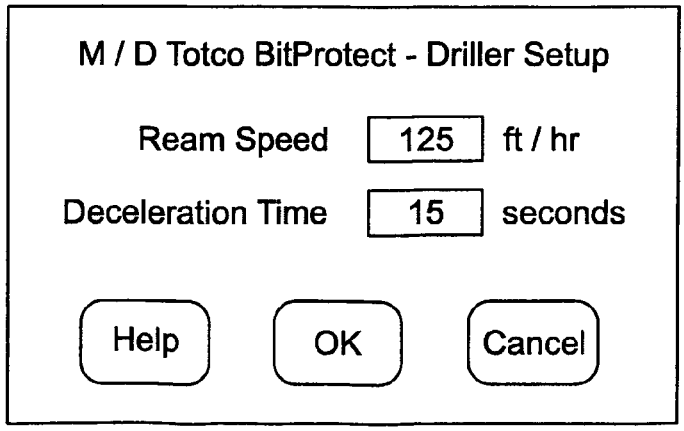

AUTOREAMING SYSTEMS AND METHODS

CROSS-REFERENCE TO RELATED APPLICATION

This is a continuation-in-part of U.S. application Ser. No. 10/745,247 filed on Dec. 23, 2003, issued as U.S. Pat. No. 7,100,708 on Sep. 5, 2006; all of said application and said patent are incorporated fully herein by reference for all purposes; and from and based on said application and said patent the present invention claims priority under the Patent Laws.

BACKGROUND OF THE INVENTION

1. Field of the Invention

The invention relates generally to systems for drilling boreholes for the production of hydrocarbons. More particularly, the invention relates to devices and methods for protecting the bit during the initial stages of the drilling operation in order to extend the lifetime of the bit.

2. Description of Related Art

To obtain hydrocarbons such as oil and gas, boreholes are drilled by rotating a drill bit attached at a drill string end. Modem drilling systems generally employ a drill string having a bottomhole assembly (BHA) and a drill bit at end thereof that is rotated by a drill motor (mud motor) and/or the drill string. Pressurized drilling fluid (commonly known as the "mud" or "drilling mud") is pumped into the drill pipe to rotate the drill motor and to provide lubrication to various members of the drill string including the drill bit. The drill pipe is rotated by a prime mover, such as a rotary table, to facilitate directional drilling and to drill vertical boreholes.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill bit rotational speed (rpm of the surface motor coupled to the drill pipe) and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots that provide a macro picture of the subsurface formations and a pre-planned borehole path. For drilling multiple boreholes in the same formation, the operator also has information about the previously drilled boreholes in the same formation. Additionally, various downhole sensors and associated electronic circuitry deployed in the BHA continually provide information to the operator about certain downhole operating conditions, condition of various elements of the drill string and information about the formation through which the borehole is being drilled.

Typically, the information provided to the operator during drilling includes drilling parameters, such as WOB, rotational speed of the drill bit and/or the drill string, and the drilling fluid flow rate. In some cases, the drilling operator is also provided selected information about bit location and direction of travel, bottomhole assembly parameters such as downhole weight on bit and downhole pressure, and possibly formation parameters such as resistivity and porosity. Typically, regardless of the type of the borehole being drilled, the operator continually reacts to the specific borehole parameters and performs drilling operations based on such information and the information about other downhole operating parameters, such as bit location, downhole weight on bit and downhole pressure, and formation parameters, to make decisions about the operator-controlled parameters.

During the initial part of a drilling operation, the bit is prone to damage. The BHA must be set down into the formation to be drilled as rotation of the bit is begun. Typically, the driller does this manually. As such, the setting down process may be performed differently each time drilling is begun. If setting down and rotation is begun too quickly, the bit may be damaged by the suddenness of the contact with the rock, or the drill string may become overtorqued. If setting down and rotation are done too slowly, rig time is wasted. This is especially true for a new bit, wherein it must be "drilled in" to establish a new pattern. Also, in reaming operations the resumption of drilling with optimal drilling parameters when a re-introduced bit contacts hole bottom should be commenced as soon as possible.

A few systems have been proposed for automated operation of portions of a drilling operation. In general, such systems establish a set point for WOB, and then control the drilling equipment to reach the setpoint quickly. This may be counterproductive. Attempting to achieve the setpoint quickly may cause a step-change to the system that results in damage to the bit, overtorquing of the drill string and other problems.

U.S. Pat. No. 4,875,530 issued to Frink et al., for example, describes an automatic drilling system wherein a required speed and bit weight is input into the system by an operator. A controller device electronically senses the weight on bit and provides instantaneous feedback of a signal to a hydraulically driven drawworks which is capable of maintaining precise bit weight throughout varying penetration modes. Frink's system provides a setpoint for the bit weight. However, Frink also seeks to achieve the setpoint quickly and without regard to protection of the bit.

U.S. Pat. No. 6,382,331 issued to Pinckard describes a method and system for optimizing the rate of bit penetration while drilling. Pinckard's arrangement collects information on bit rate of penetration, weight on bit, pump or standpipe pressure, and rotary torque data during drilling. This information is stored in respective data arrays. Periodically, the system performs a linear regression of the data in each of the data arrays with bit rate of penetration as a response variable and weight on bit, pressure, and torque, respectively, as explanatory variables to produce weight on bit, pressure, and torque slope coefficients. The system calculates correlation coefficients for the relationships between rate of penetration and weight on bit, pressure, and torque, respectively. The system then selects the drilling parameter with the strongest correlation to rate of penetration as the control variable. Pinckard's system, however, does not attempt to solve the problems associated with the start of drilling or drilling in of a bit.

There is a need for a system that overcomes the problems associated with prior art systems as regards the starting of drilling, and, in particular situations, resuming drilling after reaming.

BRIEF SUMMARY OF THE INVENTION

The present invention discloses, in at least certain aspects, methods for controlling movement of a bit of a drilling assembly during reaming of a hole; the method, in one aspect, including determining a speed for downward movement of the bit, moving the bit downward in a hole at said speed, determining a time period for deceleration of the downwardly moving bit as it approaches the hole bottom, determining a value for a target parameter related to the reaming of the hole to be achieved as the bit comes down to the bottom of the hole, decelerating the movement of the bit for the time period, and ending the period when the value is achieved at the bottom of the hole. "Reaming" includes moving a drillstring with a bit down into an already-drilled hole to advance the bit to the bottom of the hole whether additional widening of the already-drilled hole is accomplished or not by the downwardly advancing bit and whether or not the bit is rotating. The present invention discloses systems for and computer readable mediums programmed to effect such methods.

The present invention, in certain aspects, addresses and overcomes the foregoing disadvantages of the prior art by providing a system that optimizes the drilling process. The system and methods of the present invention seek to provide protection to the bit during the drilling process, and particularly during the initial portion of the drilling operation, when the bit is set down into the formation.

In certain embodiments, an autodriller device is provided according to the present invention that operates the drawworks for hoisting/lowering of and rotation of the drill string. The autodriller includes a controller that is programmed to provide an automatic bit protection sequence that can be initiated during the initial stage of set down of the bit within the formation. The automatic protection sequence establishes a setpoint for a parameter of interest that is associated with operation of the drilling system. This parameter of interest may be the actual WOB. It may also be measured torque on the drill string, ROP, or differential mud motor pressure. At the start of drilling, the controller initiates a gradual increase in the parameter of interest in order to achieve the setpoint. The controller may automatically choose the bit protection process or it can be provided with an on/off switch so that the driller may selectively choose to use or not use bit protection. Additionally, the bit protection sequence may be adjustable so that varying degrees of gradualness may be selected.

In other aspects, the present invention provides a system and method in which the controller of the autodriller is provided with measured data for the torque on the BHA, rate of penetration (ROP) and/or the differential pressure of the mud motor of the drilling system. Each of these parameters is provided with a predetermined setpoint, and each may be selected as the controlling parameter for operation of the autodriller. In yet a further embodiment, the controller will automatically select a controlling parameter from among these parameters.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

Accordingly, the present invention includes features and advantages which are believed to enable it to advance drilling technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious reaming systems, computer readable mediums, and methods of their use;

Such systems, etc. for automatic reaming; and

Such systems, etc. for providing controlled deceleration of a reaming bit until it reaches a bottom of a hole being reamed.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 8A is a side schematic view in cross-section illustrating a reaming method according to the present invention.

FIG. 8B is a side schematic view in cross-section illustrating a reaming method according to the present invention.

FIG. 9 is a graph illustrating parameters of a reaming method according to the present invention.

FIG. 10 depicts a display panel useful in a reaming method according to the present invention.

Figure 1:
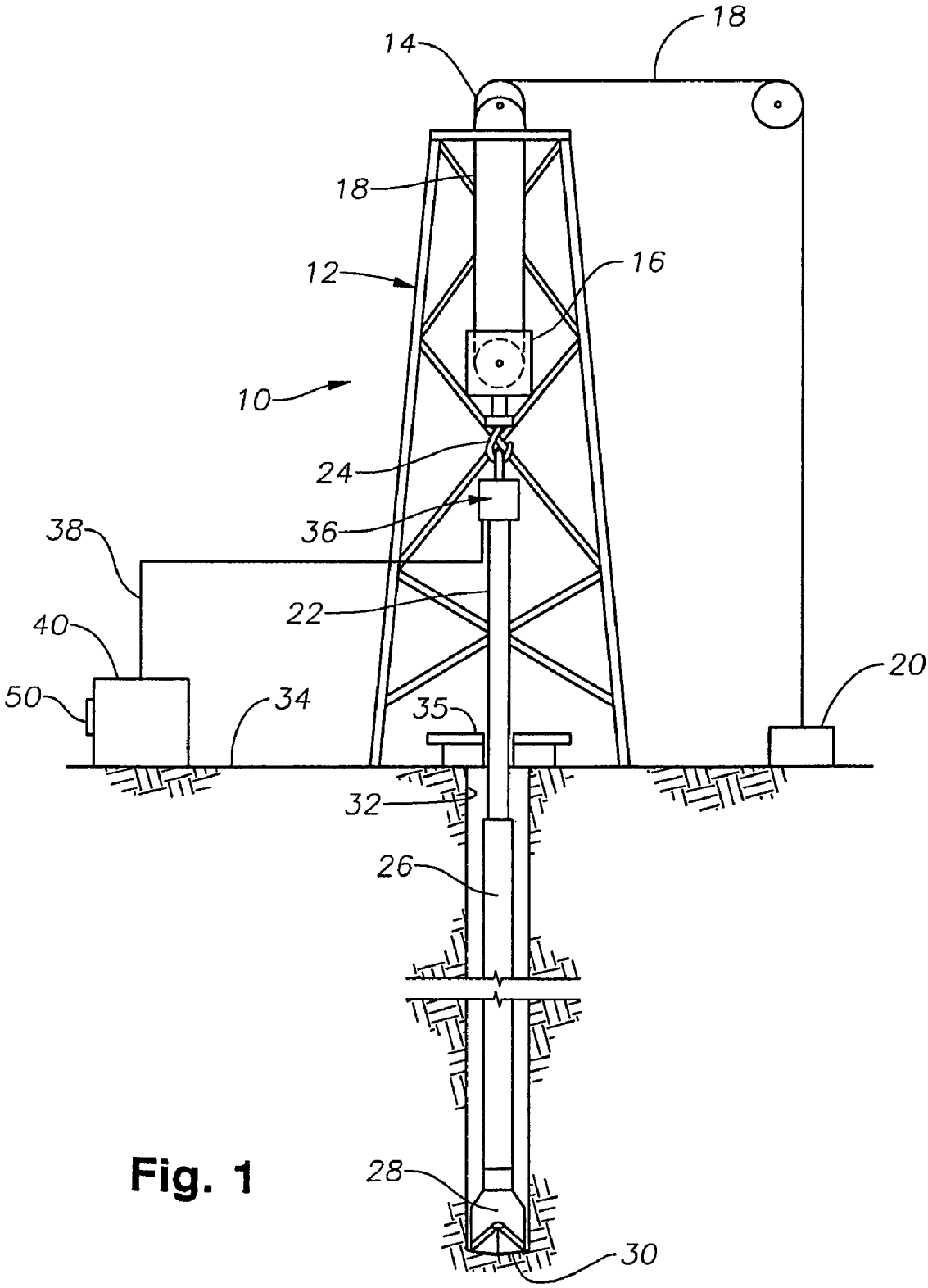
FIG. 1 is a schematic depiction of an exemplary drilling system having an autodriller and which incorporates a system constructed in accordance with the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION

FIG. 1 illustrates, in schematic fashion, an exemplary drilling rig 10 with an automatic drilling system. The rig 10 includes a supporting derrick structure 12 with a crown block 14 at the top. A traveling block 16 is movably suspended from the crown block 14 by a cable 18, which is supplied by draw works 20. A kelly 22 is hung from the traveling block 16 by a hook 24. The lower end of the kelly 22 is secured to a drill string 26. The lower end of the drill string 26 has a bottom hole assembly 28 that carries a drill bit 30. The drill string 26 and drill bit 30 are disposed within a borehole 32 that is being drilled and extends downwardly from the surface 34. The kelly 22 is rotated within the borehole 32 by a rotary table 35. Other features relating to the construction and operation of a drilling rig, including the use of mud hoses, are well known in the art and will not be described in any detail herein.

A load cell assembly, generally shown at 36, is disposed below the traveling block 16. The load cell assembly 36 is of a type known in the art and contains a sensor for measuring the entire weight of the drill string 26 and kelly 22 below it. It is noted that the load cell assembly 36 might also be located elsewhere, the location shown in FIG. 1 being but an exemplary location for it. A suitable alternative location for the load cell assembly 36 would be to incorporate the load cell assembly into the cable 18 to measure tension upon the cable 18 from loading of the drill string 26 and kelly 22.

The load cell assembly 36 is operably interconnected via cable 38 to a controller 40. The controller 40 is typically contained within a housing (not shown) proximate the derrick structure 12. The controller 40 is preferably programmable and embodied within a drawworks control system, or autodriller, of a type known in the art for control of the raising and lowering, rotation, torque and other aspects of drill string operation. One such autodriller, which is suitable for use with the present invention, is that described in U.S. Pat. No. 6,029,951, issued to Guggari. That patent is owned by the assignee of the present application and is herein incorporated by reference. The controller 40 is operably interconnected with the drawworks 20 for control of the payout of cable 18 which, in turn, will raise and lower the drill string 26 within the wellbore 32. Additionally, the controller 40 is operably associated with the rotary table 35 for control of rotation of the drill string 26 within the wellbore 32.

Prior to lowering the drill string 26 into the wellbore 32 to engage the bottom of the wellbore 32, the load cell assembly 36 provides a reading to the controller 40 that is a baseline "zero" WOB. This zero reading is indicative of the load on load cell assembly 36 with just the hookload, i.e., the kelly 22, drill string 26 and BHA 28. In other words, with this hookload, the actual weight on the bit 30 is essentially zero since the bit is hanging free and has not yet been set down into the wellbore 32. The actual WOB is determined by subtracting the reference hookload value from the reading provided by the load cell assembly 36. As the bit 30 is lowered into the wellbore 32, and prior to the bit 30 engaging the formation, mud pumps are started to flow drilling mud down through the drill string 26 for lubrication of the bit 30. Because this operation is well understood by those of skill in the art, it is not described in any detail herein. Additionally, rotation of the drill string 26 is started. As the drill string 26 and BHA 28 are further lowered into the wellbore 32, the bit 30 eventually will be brought into contact with the bottom of the wellbore 32, as the BHA 28 is set down. At this point, the reading on the load cell assembly 36 will be decreased as the weight of the hookload is born by the bit 30. The decrease in weight on the load cell assembly 36 provides a measurement of the increase in WOB. The controller 40 can selectively adjust the rate of increase of WOB by controlling the braking force provided by the drawworks 20 on cable 18. The controller 40 is preprogrammed with a WOB set point, which is typically selected by the driller prior to the commencement of drilling operations.

Figure 2:
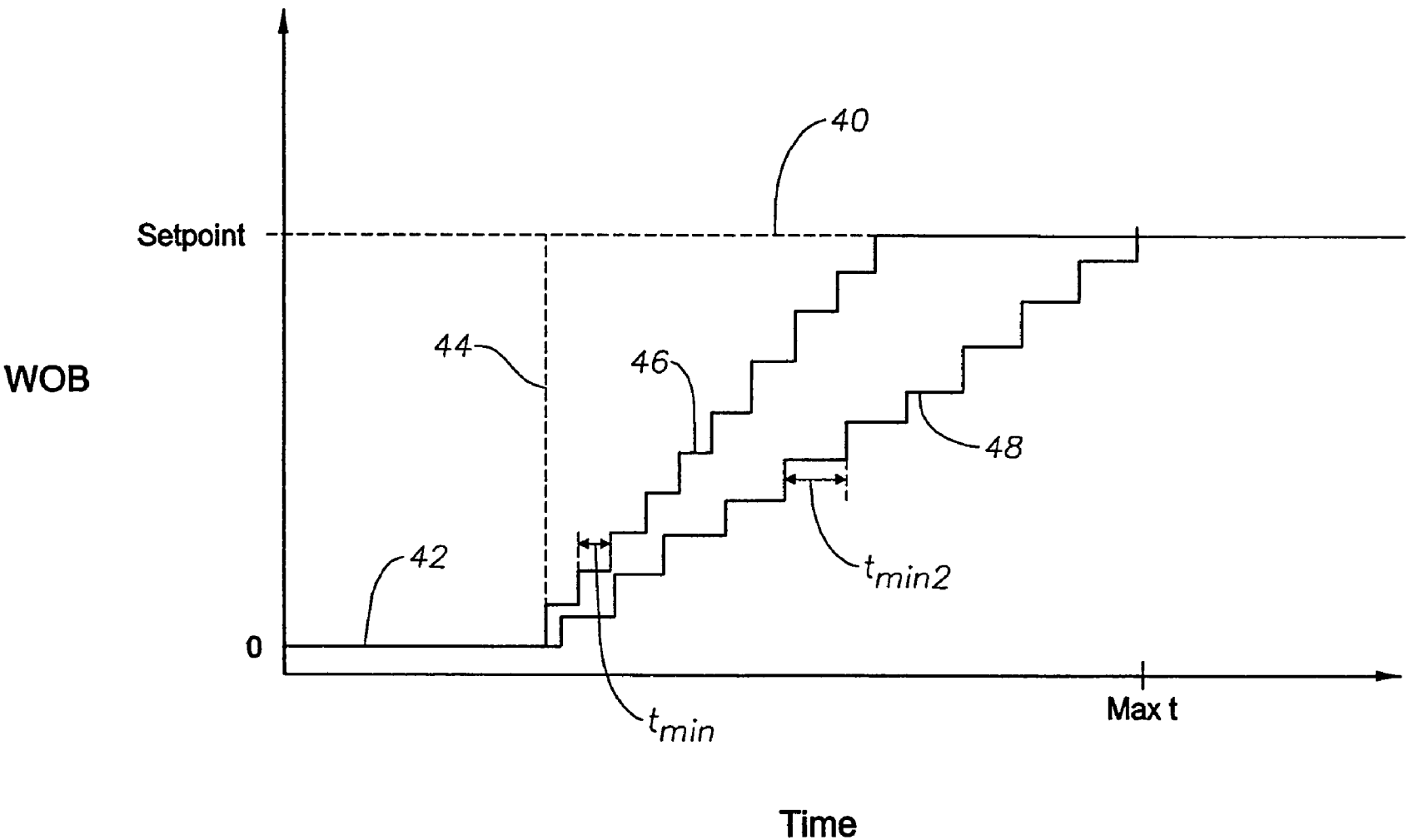
FIG. 2 is a chart illustrating controlled gradual achievement of a bit weight setpoint.

When in the "bit protection mode," the controller 40 seeks to adjust the WOB toward a WOB setpoint in a gradual manner. FIG. 2 is a graph that illustrates gradual adjustment of the actual WOB toward the WOB setpoint in a gradual manner. FIG. 2 depicts the actual weight on bit (WOB) versus time for the setting down portion of a drilling operation. A WOB setpoint is shown at line 40, indicating a desired WOB for the drilling operation. The actual zero WOB, prior to set down, is indicated by line 42. Line 44 depicts a rapid, step-change-type adjustment of the WOB toward the setpoint 40. This is undesirable. Line 46 illustrates a gradual increase in the actual WOB 42 toward the setpoint WOB 40, in accordance with the present invention. As will be described in greater detail below, the controller 40 accomplishes this gradual increase by ensuring that weight is added to the bit 30 in discrete increments and that there is an increment of time (t.sub.min) between additions of each increment of added weight. The stair step appearance of the line 46 is due to the placement of the increment of time (t.sub.min) between each increase in weight.

Line 48 also illustrates a gradual increase in the actual WOB 42 to the setpoint WOB 40. As is apparent, there is a greater degree of gradualness in reaching the setpoint WOB 40 along the second line 48. This greater degree of gradualness is due to the use of a longer minimum time period (t.sub.min2). In the latter instance, also, the controller 40 has been programmed to increase the actual WOB to the setpoint WOB 40 within a set period of time (max t), or target time. The driller may specify a target time (max t) by inputting this parameter into the controller 40 for the actual WOB to be brought to the WOB setpoint. In this way, the degree of gradualness may be adjusted.

Figure 2A:
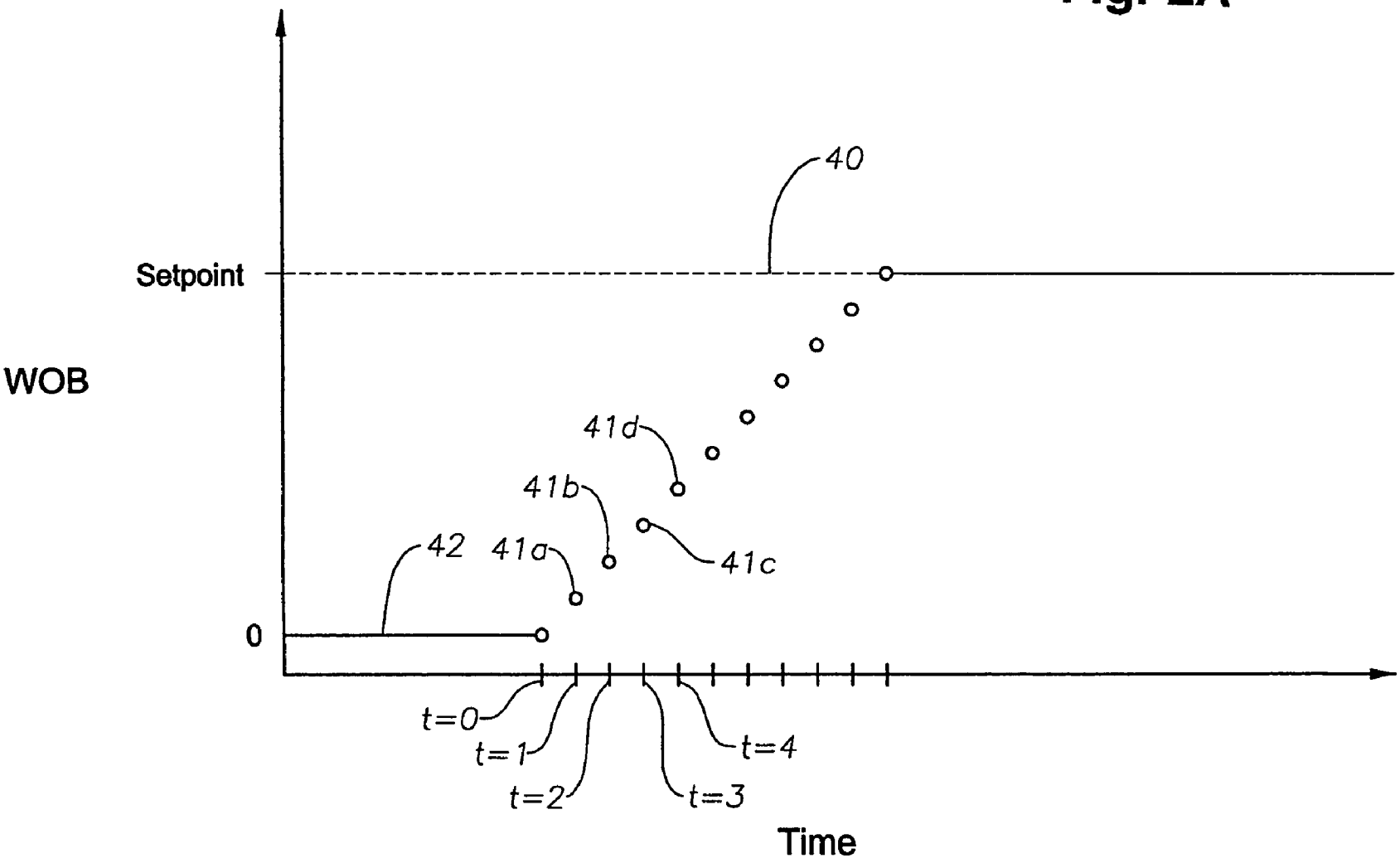
FIG. 2A depicts an alternative technique for providing controlled gradual achievement of a bit weight setpoint.

An alternative method for increasing the weight on bit in a gradual manner is illustrated by FIG. 2A. According to this method, the controller 40 calculates intermediate setpoints for the WOB at various points in time from the beginning of drilling to achievement of the setpoint. The controller 40 will control the drawworks 20 to maintain the actual WOB at the intermediate setpoints. FIG. 2A shows an example. In this example, the setpoint 40 has been established prior to the start of drilling. At the start of drilling, t=0 in FIG. 2A. The controller 40 then calculates an intermediate setpoint (shown as intermediate setpoint 41*a* in FIG. 2A) for the actual WOB for a specific point in time (i.e., t=1) after the start of drilling. The controller 40 then controls the drawworks 20 to increase the actual WOB to this intermediate setpoint. The controller 40 will also calculate additional intermediate setpoints 41*b*, 41*c*, 41*d*, etc. for subsequent time periods (t=2; t=3; t=4, . . . ) and continuing until the actual WOB reaches the WOB setpoint 40. The intermediate setpoints 41*a*, 41*b*, 41*c*, . . . may be calculated using known mathematical techniques for determining intermediate values between two known endpoints. One suitable technique for making such a determination is the slope-intercept form of linear equation:

$$y=mx+b$$

where:

m=slope;

b=the value where the line crosses the y-axis; and x and y are the coordinates for the y-intercept.

Figure 3:
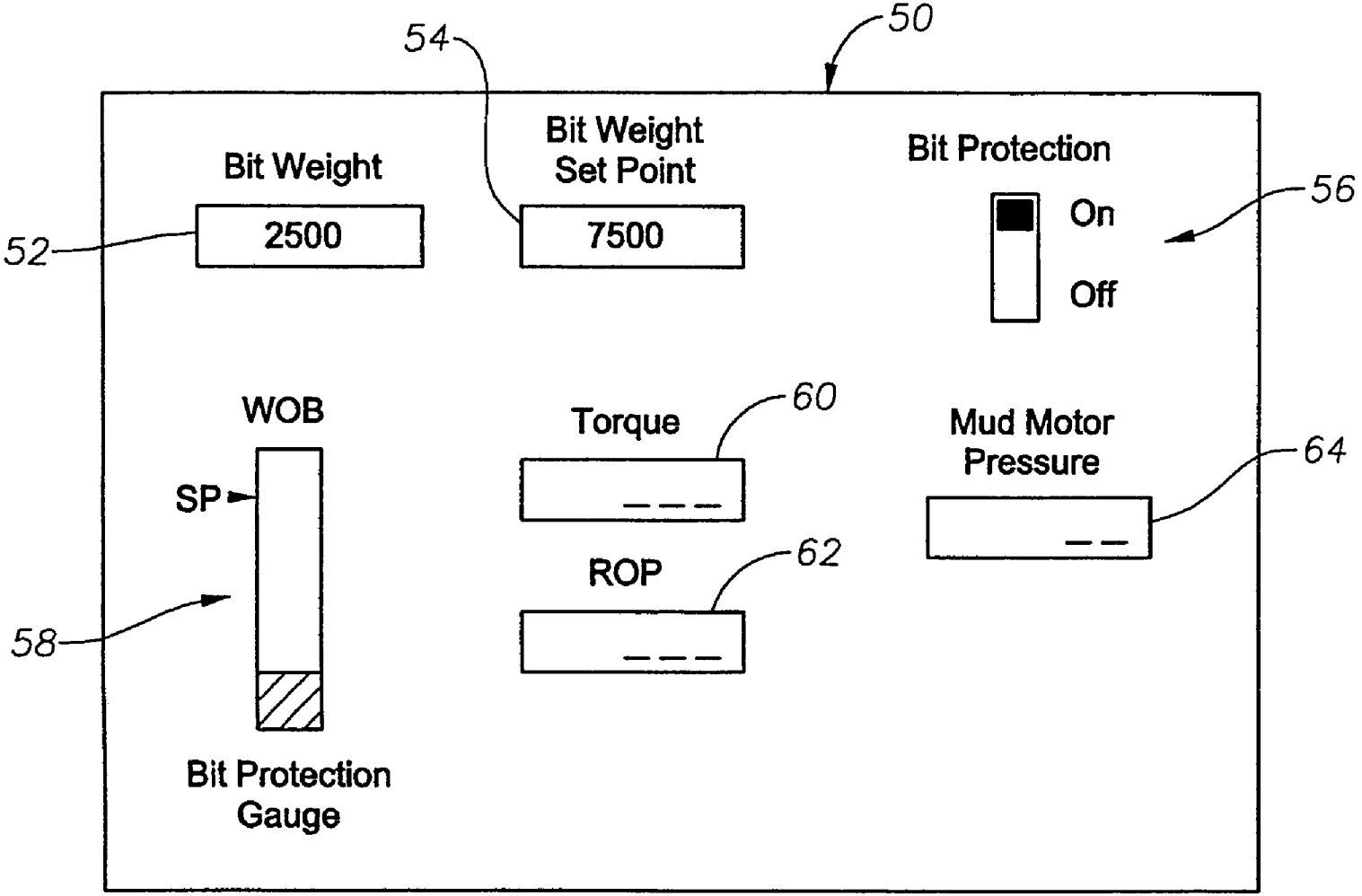
FIG. 3 depicts portions of an exemplary display panel for the controller of the autodriller device.

A display/control panel is associated with the controller 40 so that a driller may have actuation control over the controller 40 and to have a visual indication of the actual WOB, WOB setpoint, and other parameters. FIG. 3 illustrates a portion of an exemplary display/control panel 50. The panel 50 presents numerical representations of the actual WOB 52 and the WOB set point 54. The latter value is typically input into the controller 40 by a keyboard or other input device that is known in the art. The panel 50 also provides a control switch 56 for turning the bit protection feature on and off. Additionally, there is a bit protection gauge 58 that will graphically depict the increase in actual WOB toward the setpoint WOB. Additionally, the panel 50 provides a numerical display 60 for torque, as measured at the surface. As those of skill in the art recognize, torque may be measured at the bit by a sensor (not shown) located proximate the rotary table 35. Because the measurement and monitoring of torque upon the drill string is well understood in the art, it will not be described herein. The panel 50 also provides a numerical display 62 for the rate of penetration (ROP) of the bit 30 and a display 64 for the differential pressure of the mud motor (not shown) that is associated with the drilling rig 10 to supply drilling mud to the bit 30.

Figures 4A, 4B, 4C, 4D:
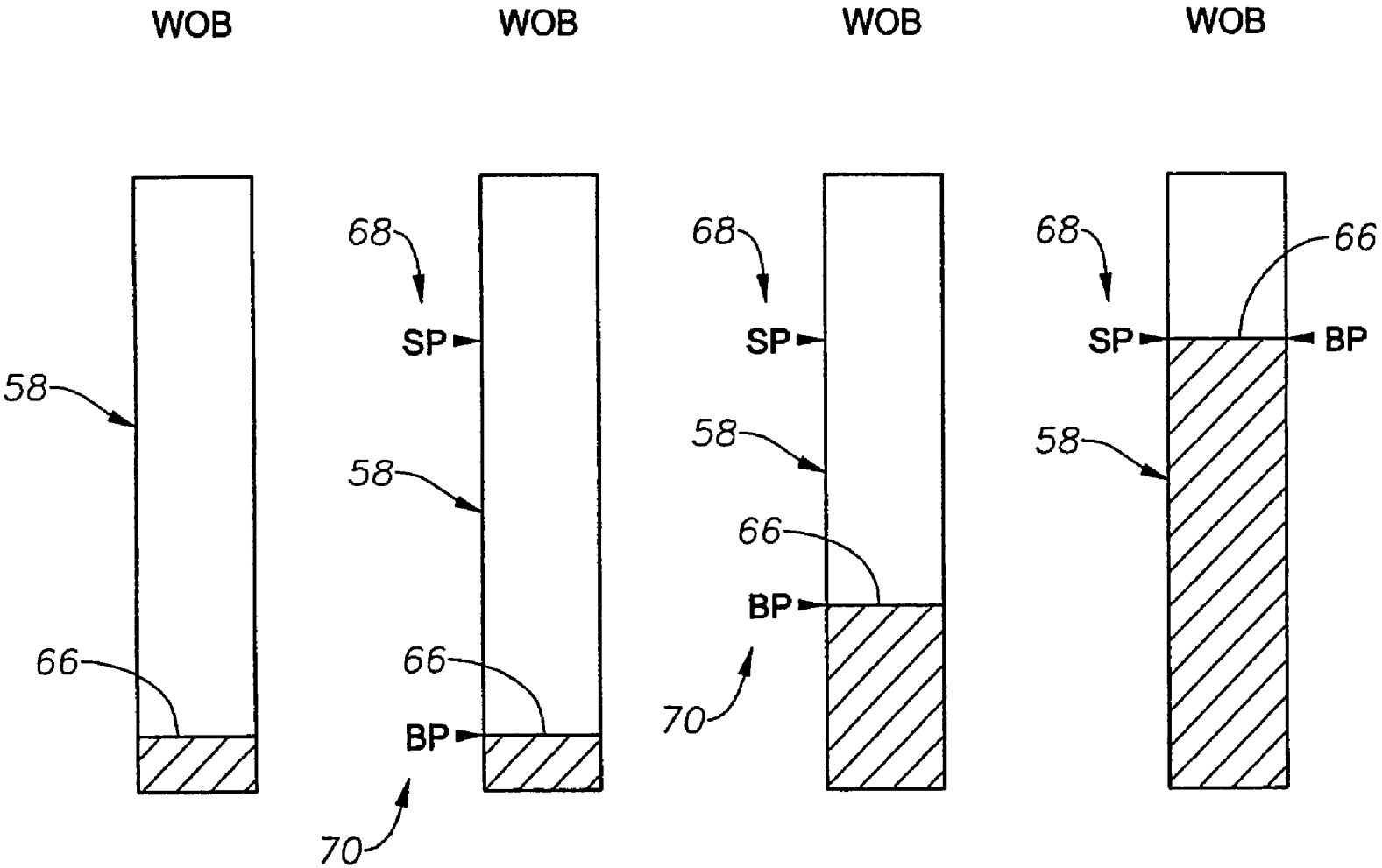
FIG. 4A illustrates operation of an exemplary display gauge for the automatic protection sequence.
FIG. 4B illustrates operation of an exemplary display gauge for the automatic protection sequence.
FIG. 4C illustrates operation of an exemplary display gauge for the automatic protection sequence.
FIG. 4D illustrates operation of an exemplary display gauge for the automatic protection sequence.

FIGS. 4A-4D illustrate operation of the bit protection gauge 58 during the initial portion of a drilling operation, principally during the time that the bit 30 is "set down" into the formation or earth for the start of drilling. In FIG. 4A, the actual WOB is at the baseline or zero value, indicated by the top of the colored area 66, which represents the actual WOB. At this point, no WOB setpoint has been input into the controller 40. In FIG. 4B, a WOB setpoint has been input into the controller 40 and is indicated by the graphical arrow "SP" indicator 68. In addition, the driller has actuated the switch 56 to turn on the bit protection feature, and this is illustrated by the graphical arrow "BP" indicator 70, which is aligned with the top of the colored area 66. In FIG. 4B, the bit 30 has not yet been set down. In FIG. 4C, the controller 40 is setting the bit 30 down in a gradual manner, and the actual WOB indicator 66 rises. In FIG. 4D, the actual WOB has reached the desired setpoint WOB. The "BP" indicator 70 then disappears, showing that the bit protect feature is no longer active.

Figure 5:
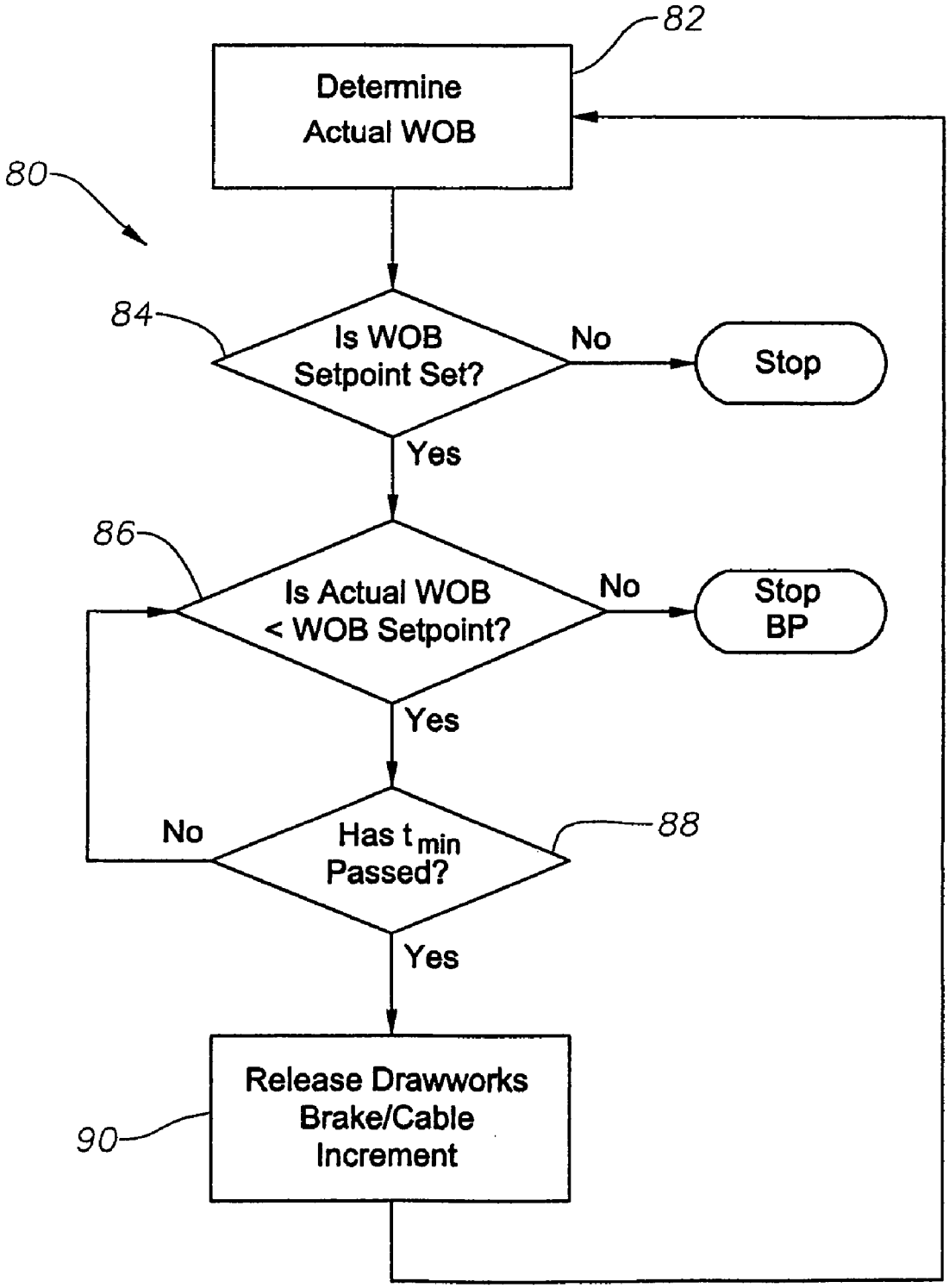
FIG. 5 is a flow chart depicting steps in an exemplary method of control in accordance with the present invention.

In accordance with the present invention, the controller 40 is programmed to provide a "bit protection" operating sequence. The sequence protects the bit and other components from damage that might result during a too rapid increase in WOB during setdown. FIG. 5 depicts a flowchart showing steps in an exemplary control method 80 that is performed by the controller 40 in accordance with the present invention during operation of the bit protect feature. According to the method 80, the controller first determines the actual WOB, which is provided by the load cell assembly 36. This is shown at step 82. In step 84, the controller 40 determines if the autodriller is on and there has been a WOB setpoint entered by the driller. If so, the controller 40 compares the two values in step 86. If the actual WOB is not less than the setpoint WOB, the controller 40 takes no action and the bit protection sequence is stopped. However, if the actual WOB is less than the setpoint WOB, the controller 40 proceeds to step 88 wherein it determines whether the minimum interval of time t.sub.min (or t.sub.min2) has passed before additional weight may be placed upon the bit 30. If not, the controller 40 places no additional weight on the bit. If t.sub.min (or t.sub.min2) has occurred since additional weight was placed on the bit 30, the controller 40 proceeds to step 90 wherein the brake (not shown) for the drawworks 20 is released by the controller 40 to cause a predetermined increment of cable to be unwound, thereby placing an additional increment of weight on the bit 30. Depending upon the particular type of drawworks 20 that is used by the drilling rig 10, the controller 40 might adjust an on/off style brake, a continuous brake adjustment, or a motor control. This process 80 will continue in an iterative fashion until the actual WOB is at the setpoint WOB. It is noted that the use of a minimum interval of time between placements of additional weight on the bit 30 ensures that weight is added in a gradual manner. The controller 40 may, alternatively, implement the method described with respect to FIG. 2A previously of establishing a plurality of intermediate setpoints and then controlling the drawworks 20 to achieve the intermediate setpoints until the WOB setpoint 40 is reached.

Figure 6:
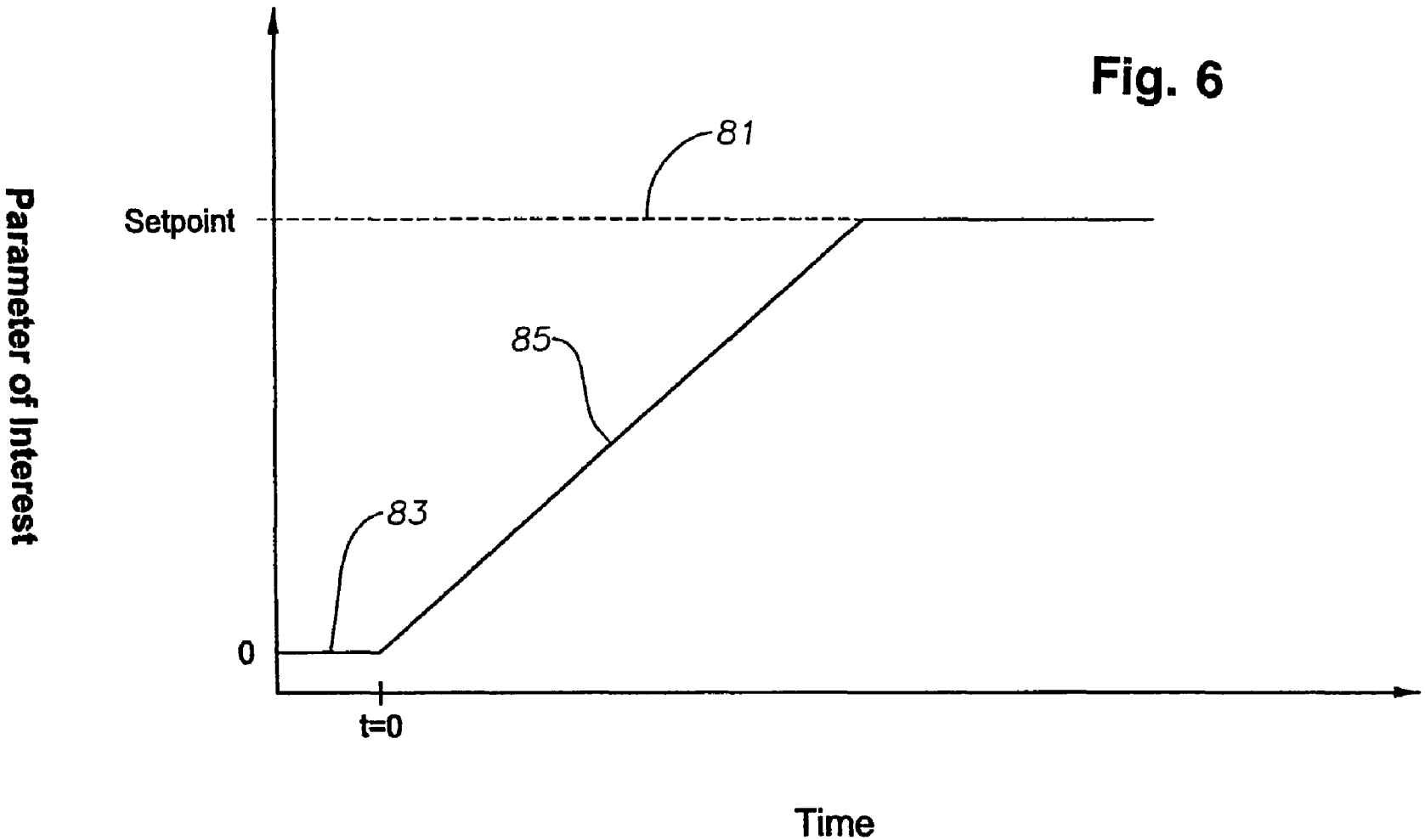
FIG. 6 is a chart depicting control of a parameter of interest associated with the drilling process wherein control is substantially continuous so as to use time steps that approach being infinitely small.

In an alternative embodiment, the processor 40 may be programmed to control the drilling rig 10 using a controlling setpoint that is selected from among other drilling parameters. These other drilling parameters are values that are typically measured and monitored during a drilling operation and include the torque, rate of penetration (ROP) and/or the differential pressure of the mud motor of the drilling system. If, for example, it is desired to use ROP as the controlling parameter, a desired setpoint is selected for ROP. The controller 40 then compares the actual rate of penetration to the ROP setpoint, in the same manner as the actual WOB was compared to the setpoint WOB via process 80 described above. The controller 40 will adjust the payout of cable 18, as previously described, until the actual ROP matches the setpoint ROP. FIG. 6 is a graph that depicts the use of a setpoint 81 and the gradual achievement of that setpoint for a parameter of interest 83. The parameter of interest 83 may be ROP, torque, or differential mud pump pressure, as well as WOB. As depicted generally in FIG. 6, the parameter of interest 83 is increased from the start of drilling at t=0 to the setpoint 81 in a gradual manner, illustrated by line 85 until the setpoint 81 is reached. The gradual increase in the parameter of interest 83 is achieved by the controller 40 using methods previously described for gradual increase of the actual WOB (i.e., use of incremental increases spaced apart by time intervals or the establishment of a plurality of intermediate setpoints for the parameter of interest).

Figure 7:
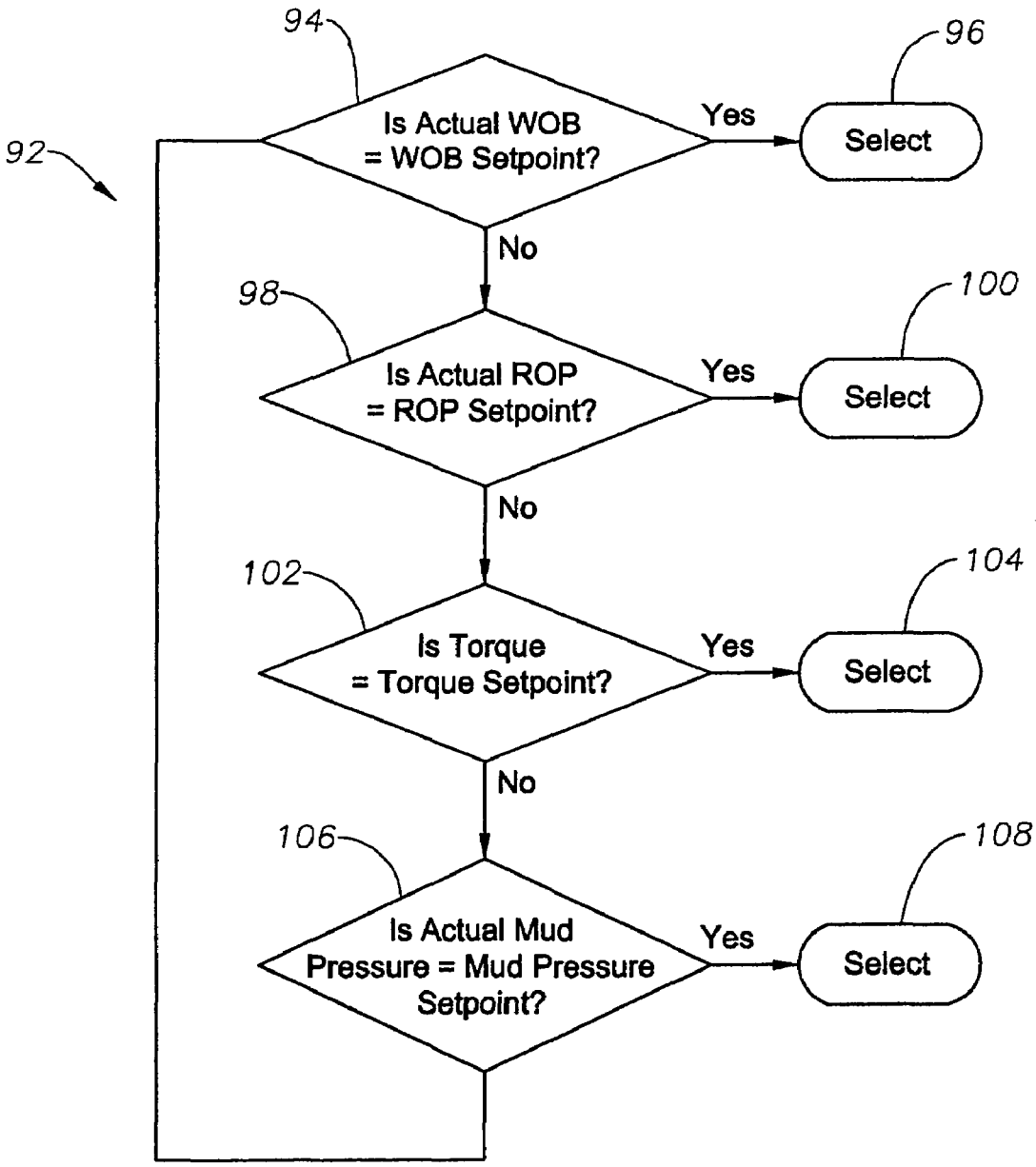
FIG. 7 is a flow chart depicting steps in a further exemplary control method in accordance with the present invention wherein the controller selects a controlling parameter automatically from among several drilling parameters.

In yet a further alternative embodiment of the invention, the controller 40 will automatically select from among the available drilling parameters to use as the controlling parameter of interest. During setdown, the controller 40 monitors each of several drilling parameters, such as WOB, ROP, torque, and mud motor differential pressure. Each of these drilling parameters is assigned a setpoint value. As the controller 40 increases weight on the bit 30, each of these parameters will begin to approach its preestablished, ultimate setpoint (i.e., as WOB is increased, the rate of penetration of the drill bit 30 will also increase). The controller 40 will select the parameter to use as the system setpoint by determining which of the parameters first reaches its setpoint value. FIG. 7 is a flowchart that illustrates an exemplary selection process that might be employed by the controller 40. According to the process, generally designated as 92, the controller first determines whether the actual WOB has reached the WOB setpoint (step 94). If so, the controller 40 selects the WOB setpoint as the setpoint for control of actual WOB (step 96). If the controller 40 determines that the WOB setpoint has not been reached, it then determines whether the actual ROP has reached the ROP setpoint (step 98). If so, then the ROP setpoint is selected as the setpoint for control of ROP (step 100). If the actual ROP has not reached the ROP setpoint, the controller 40 then determines whether torque has reached its predetermined setpoint (step 102). If it has, then the torque parameter is chosen by the controller as the parameter for control of torque (step 104). If not, the controller 40 proceeds to determine whether the actual mud pump pressure has reached the selected setpoint for mud pump pressure (step 106). If so, that parameter is chosen as the controlling parameter (step 108). This process 92 will continue in an iterative fashion until a selection is made. Thus, the first parameter to reach its designated set point will be selected by the controller 40 as the controlling setpoint parameter for operation of the drilling rig 10.

It is noted that the steps for the processes according to the present invention described above and below may be hardwired into the controller or provided by programming of the controller 40. Additionally, the steps may be accomplished by using instructions that are provided to the controller via removable storage media, such as diskettes, CD-ROMs and other known storage media. These computer-readable media, when executed by the controller 40, will cause it to control operation of the drilling rig 10 to perform the described methods.

Reaming is a method of re-introducing a drillstring with a drill bit into an already-drilled hole to move the bit down to the hole bottom to resume drilling from that point, In some cases of reaming no widening of the already-drilled hole occurs while in others "drilling again" of the already-drilled hole occurs; e.g., as shown in FIG. 8A, a drilling system 120 with a bit 122 is reaming a previously-drilled hole 124 in a formation 128 to a reamed hole diameter of a new hole 126; or as shown in FIG. 8B a bit 132 on a drillstring 130 is reintroduced into an already-drilled hole 134 in a formation 138 and is moved down to a bottom 136 of the hole 134 to resume drilling. Often each new section of a drilled hole is reamed before adding another stand or joint to a drillstring for further drilling. Reaming, in certain aspects, is normally a low-energy process, since minimal rock is removed. However, some situations, such as drilling an under-gauge hole, can be challenging, due to drill bits being designed for drilling out a full-cross-section of rock, as opposed to drilling only the outer ring and encountering high side forces from the sloped sides of the hole. In any method according to the present invention at some point in a reaming process one or more of a variety of drilling parameters (e.g., weight on bit, fluid differential pressure across a mud motor, drillstring rotation speed, ROP, and/or drillstring torque) can come into play in the sense of becoming an overarching parameter in terms of which the reaming process is then controlled; e.g., when a collapsed hole is encountered or bridging of the formation before hole bottom is reached.

In a reaming method according to the present invention, the drillstring is lowered so that the bit again encounters the bottom of an already-drilled hole and drilling again commences. The controller 40 (as disclosed above) is programmed to accept as inputs a "Ream Speed" and a defined "deceleration time." The "Ream Speed" is a speed at which the bit 122 or the bit 132 progresses downward in the hole (the hole 124 or 134, respectively). The "deceleration time" is a period of time calculated by the controller 40 (or by some other computer on-site or remote in communication with the controller 40) during which the bit decelerates from the Ream Speed to a point at which a target rate of penetration is reached. This deceleration time period is calculated (by the controller 40 or another computer) based on the calculated distance of the bit from the bottom of the hole and on other factors, e.g., mass of the drillstring, capability of the brake system, kinetic energy of the system or some combination of these factors. Based on this calculated deceleration time period, a time is calculated at which to begin deceleration and a time is calculated at which the bit should be at or just above the bottom of the hole.

In one particular aspect, the distance traversed during the deceleration time is calculated so that a deceleration occurs over a minimum distance. In this way the shortest time period is employed for deceleration so that the overall time for drilling the hole is optimized.

In one particular aspect, deceleration is constant to achieve a minimum safe reliable deceleration. In other aspects, deceleration is at different rates, depending on situations that may occur during reaming. Deceleration rate can, according to the present invention, be adjusted during reaming; e.g., but not limited to, when bit reliability is questionable or hole depth is uncertain.

When deceleration is not linear, it can occur in separate segments, each beginning with its own setpoint and continuing to the beginning of the next segment having its own setpoint. In certain aspects, in reaming methods according to the present invention, the methods include establishing a final setpoint for a parameter of interest, monitoring the parameter of interest during reaming, establishing a plurality of intermediate setpoints and sequentially achieving the intermediate setpoints as reaming progresses, and proceeding with reaming until the final setpoint is reached.

In certain systems for providing protection to a drill bit according to the present invention during reaming, the systems have a sensor for measuring an operational parameter of interest, and a controller to receive values for the measured parameter of interest from the sensor and to compare the values to a predetermined setpoint. The controller further adjusts the reaming operation in separate discrete segments in separate predetermined time periods in response to valuse received for the parameter of interest. A final setpoint is reached in agradual manner. In certain embodiments and aspects, a controller according to the present invention has a computer readable medium with instructions that, when executed, cause the controller to: control operation of a drilling assembly with a bit according to a method; the method including establishing a final setpoint for a parameter of interest in a reaming operation, monitoring the parameter of interest during the reaming operation, changing the parameter of interest sequentially through a plurality of intermediate values during reaming, and reaching the final setpoint value.

In one particular aspect the driller inputs a target ROP to be achieved when the bit (122 or 132) encounters the bottom of the hole (124 or 134) so that at this point the bit is progressing at the target ROP, an ROP which typically is not suitable for reaming, but for drilling new hole. In any reaming method according to the present invention any drilling parameter can be used as the "target" other than ROP.

In one particular aspect a reaming method according to the present invention is automatic. The controller 40 is preprogrammed with a Ream Speed and Deceleration Time so that when personnel, e.g. a driller, activates reaming (by pushing a "Start" button or by turning on an autodriller), the drilling system automatically begins reaming at the pre-set Ream Speed and continues reaming through the pre-set Deceleration Time period. The drilling system then decelerates for the deceleration time period until the Target ROP is reached at hole bottom. Once the Target ROP is achieved, the system automatically goes into the usual autodriller mode and continues drilling (e.g. continues drilling the hole 126, FIG. 8A, or the hole 134, FIG. 8B).

FIG. 9 illustrates a drilling system reaming at a pre-selected bit lowering Ream Speed (vertical axis of graph) until the beginning of a pre-selected deceleration time period ("Decel Time") (Time on horizontal axis). Constant deceleration is indicated until the Target ROP is achieved at the hole bottom ("Bit Position equals Hole Depth").

FIG. 10 illustrates a system controller display panel 130 for preprogramming the controller 40 with a pre-selected Ream Speed and a pre-selected Deceleration Time (pre-selection is done via manual user input (on-site or remot) or automatically by the controller or by another computer). In one aspect, as may be the case for every display panel herein, a touch screen display is used.

Pushing the "HELP" button presents an on-screen explanation fo system operation, definitions of system parameters, and details of system procedures. In certain aspects, in methods according to the present invention when a drill system with a bit is reaming a hole or is performing any other operation in which a bit approaches a hole bottom to resume drilling, drilling is controlled in terms of any particular selected drilling parameter.

For example, as a bit approaches a hole bottom during a reaming process or other bit lowering process at a relatively high bit rotational speed (high RPM's), the RPM's are decreased during a deceleration time period; then, as the the bit comes to the hole bottom, the RPM's are increased so that further drilling of the hole can be commenced quickly and efficiently. Similarly, adjustments can be made regarding ROP, torque on bit, mud flow rate, drillstring rotational speed, mud motor differential pressure, or mud motor rotational speed.

The present invention, therefore, provides in some, but not in necessarily all, embodiments a method for controlling movement of a bit of a drilling assembly during reaming of an already-drilled hole, the method including: determining a ream speed for downward movement of the bit in a hole, the hole having a hole bottom; moving the bit downward in the hole at said ream speed; determining a time period for deceleration of the downwardly moving bit to the hole bottom; determining a value for a target drilling parameter for drilling beyond the bottom of the hole; decelerating the bit for the time period; and achieving the value for the target drilling parameter when the bit reaches the bottom of the hole. Such a system may have one or some, in any possible combination, of the following: wherein the already-drilled hole is not widened during reaming; wherein the deceleration is constant; wherein the target parameter is rate of penetration; wherein the bit moves a first distance at the ream speed and then the bit moves a second distance during the time period, and the second distance is a minimum distance within which a linear deceleration is achieved for the bit to be brought to the bottom of the hole; wherein a controller automatically controls movement of the bit; wherein a controller controls movement of the bit, and the controller calculates the second distance; wherein a value for the ream speed is input into the controller, a value for the time period is input into the computer, and the controller controls the movement of the bit in the hole; wherein the controller inputs the ream speed value and the time period value automatically; drilling the already-drilled hole with the bit past the hole bottom; wherein the controller automatically controls drilling by the bit after the bit is at the bottom of the hole to extend the hole past said bottom; the time period has a beginning and an end, and the decelerating occurs by sequentially decelerating to each of a plurality of intermediate setpoints between the beginning of the time period and the end of the time period, each intermediate setpoint corresponding to an intermediate value for the target drilling parameter; and/or wherein the target drilling parameter is weight on bit, differential fluid pressure across a mud motor, bit rotational speed or torque on the bit.

The present invention, therefore, provides in some, but not in necessarily all, embodiments a method for controlling movement of a bit of a drilling assembly during reaming of an already-drilled hole, the method including: determining a ream speed for downward movement of the bit; moving the bit downward in a hole at said ream speed; determining a time period for deceleration of the downwardly moving bit to the hole bottom; determining a value for a target drilling parameter for drilling beyond the bottom of the hole; decelerating the bit for the time period; achieving the value for the target drilling parameter when the bit reaches the bottom of the hole; the target drilling parameter is rate of penetration; the bit moves a first distance at the ream speed; the bit moves a second distance during the time period; the second distance a minimum distance within which a linear deceleration is achieved for the bit to be brought to the bottom of the hole;, and a controller controls movement of the bit. Such a method may include: drilling the already-drilled hole with the bit past the hole bottom.

The present invention, therefore, provides in some, but not in necessarily all, embodiments a system for controlling movement of a bit in reaming a hole, the system having: a sensor for measuring a target drilling parameter associated with drilling past a bottom of an already-drilled hole, the reaming done by a system with a bit; a controller to receive a measured target drilling parameter from the sensor and to compare the measured target drilling parameter to a predetermined setpoint for the measured target drilling parameter; and the controller adjusting deceleration of the bit as the bit approaches the setpoint. In such a system the measured target drilling parameter be rate of penetration; and/or the controller may decelerate the bit so that the decelerating occurs by sequentially decelerating to each of a plurality of intermediate setpoints between a beginning of the time period and an end of the time period, each intermediate setpoint corresponding to an intermediate value for the target drilling parameter.

The present invention, therefore, provides in some, but not in necessarily all, embodiments a computer readable medium containing instructions that, when executed, cause a controller to control operation of a drilling assembly with a bit according to the following method: determining a ream speed for downward movement of the bit in the hole, the hole having a hole bottom; moving the bit downward in a hole at said ream speed; determining a time period for deceleration of the downwardly moving bit to the hole bottom; determining a value for a target drilling parameter for drilling beyond the bottom of the hole; decelerating the bit for the time period, and achieving the value for the target drilling parameter when the bit reaches the bottom of the hole. In such a medium with instructions for such a method, the target parameter may be rate of penetration; the bit may move a first distance during the time period, the first distance being a minimum distance within which a linear deceleration can be achieved for the bit to be brought to the bottom of the hole; and/or the method may include decelerating by sequentially decelerating to each of a plurality of intermediate setpoints between a beginning of the time period and an end of the time period, each intermediate setpoint corresponding to an intermediate value for the target drilling parameter.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A method for controlling movement of a bit of a drilling assembly during reaming of an already-drilled hole, the method comprising a.) determining a ream speed for downward movement of the bit in a hole, the hole having a hole bottom, b.) moving the bit downward in the hole at said ream speed, c.) determining a time period for deceleration of the downwardly moving bit to the hole bottom, d.) determining a value for a target drilling parameter for drilling beyond the bottom of the hole, e.) decelerating the bit for the time period, and f.) achieving the value for the target drilling parameter when the bit reaches the bottom of the hole.

2. The method of claim 1 wherein the already-drilled hole is not widened during reaming.

3. The method of claim 2 wherein the bit moves a first distance at the ream speed and then the bit moves a second distance during the time period, and the second distance is a minimum distance within which a linear deceleration is achieved for the bit to be brought to the bottom of the hole.

4. The method of claim 3 wherein a controller controls movement of the bit, and the controller calculates the second distance.

5. The method of claim 4 wherein a value for the ream speed is input into the controller, a value for the time period is input into the computer, and the controller controls the movement of the bit in the hole.

6. The method of claim 5 wherein the controller inputs the ream speed value and the time period value automatically.

7. The method of claim 1 wherein the deceleration is constant.

8. The method of claim 1 wherein the target parameter is rate of penetration.

9. The method of claim 1 wherein a controller automatically controls movement of the bit.

10. The method of claim 1 further comprising drilling the already-drilled hole with the bit past the hole bottom.

11. The method of claim 10 wherein the controller automatically controls drilling by the bit after the bit is at the bottom of the hole to extend the hole past said bottom.

12. The method of claim 1 wherein the time period has a beginning and an end, and the decelerating occurs by sequentially decelerating to each of a plurality of intermediate setpoints between the beginning of the time period and the end of the time period, each intermediate setpoint corresponding to an intermediate value for the target drilling parameter.

13. The method of claim 1 wherein the target drilling parameter is weight on bit, differential fluid pressure across a mud motor, bit rotational speed or torque on the bit.

14. A method for controlling movement of a bit of a drilling assembly during reaming of an already-drilled hole, the method comprising determining a ream speed for downward movement of the bit, moving the bit downward in a hole at said ream speed, determining a time period for deceleration of the downwardly moving bit to the hole bottom, determining a value for a target drilling parameter for drilling beyond the bottom of the hole, decelerating the bit for the time period, achieving the value for the target drilling parameter when the bit reaches the bottom of the hole, the target drilling parameter is rate of penetration, the bit moves a first distance at the ream speed, the bit moves a second distance during the time period, the second distance a minimum distance within which a linear deceleration is achieved for the bit to be brought to the bottom of the hole, and a controller controls movement of the bit.

15. The method of claim 14 further comprising drilling the already-drilled hole with the bit past the hole bottom.

16. A system for controlling movement of a bit in reaming a hole, the system comprising: a) a sensor for measuring a target drilling parameter associated with drilling past a bottom of an already-drilled hole, said reaming done by a system with a bit; b) a controller to receive a measured target drilling parameter from the sensor and to compare the measured target drilling parameter to a predetermined setpoint for the measured target drilling parameter; and c) the controller adjusting deceleration of the bit as the bit approaches the setpoint.

17. The system of claim 16 wherein the measured target drilling parameter is rate of penetration.

18. The system of claim 16 wherein the controller decelerates the bit so that the decelerating occurs by sequentially decelerating to each of a plurality of intermediate setpoints between a beginning of the time period and an end of the time period, each intermediate setpoint corresponding to an intermediate value for the target drilling parameter.

19. A computer readable medium containing instructions that, when executed, cause a controller to control operation of a drilling assembly with a bit according to the following method: a.) determining a ream speed for downward movement of the bit in the hole, the hole having a hole bottom, b.) moving the bit downward in a hole at said ream speed, c.) determining a time period for deceleration of the downwardly moving bit to the hole bottom, d.) determining a value for a target drilling parameter for drilling beyond the bottom of the hole, e.) decelerating the bit for the time period, and f.) achieving the value for the target drilling parameter when the bit reaches the bottom of the hole.

20. The method of claim 19 wherein the target parameter is rate of penetration.

21. The method of claim 19 wherein the bit moves a first distance during the time period, and the first distance is a minimum distance within which a linear deceleration can be achieved for the bit to be brought to the bottom of the hole.

22. The computer readable medium of claim 19 wherein the method includes the time period has a beginning and an end, and the decelerating occurs by sequentially decelerating to each of a plurality of intermediate setpoints between the beginning of the time period and the end of the time period, each intermediate setpoint corresponding to an intermediate value for the target drilling parameter.

* * * * *